US005984052A

United States Patent [19]

Cloux et al.

[11] Patent Number: 5,984,052

[45] Date of Patent: Nov. 16, 1999

[54] ELEVATOR WITH REDUCED COUNTERWEIGHT

[75] Inventors: Jean-Noel Cloux, Les Choux; Jean-Pierre Pougny, Saint Godon; Jean-Pierre Menard, Bourg la Reine, all of France

[73] Assignee: Otis Elevator Company, Farmington, Conn.

[21] Appl. No.: 08/932,071

[22] Filed: Sep. 17, 1997

[51] Int. Cl.[6] ..... B66B 7/06

[52] U.S. Cl. ..... 187/404; 187/281

[58] Field of Search ..... 187/281, 293, 187/391, 393, 404, 414

[56] References Cited

U.S. PATENT DOCUMENTS 5,780,786 7/1998 Miyanishi ..... 187/393

FOREIGN PATENT DOCUMENTS 354020549 2/1979 Japan ..... 187/281

*Primary Examiner*—Kenneth W. Noland

[57] ABSTRACT

An elevator system includes a control system that determines the amount of load of the car, and that determines the operating speed profile of the car based upon the amount of load in the car. In a particular embodiment, the control system includes a load weighing device and uses the weight of the car to determine the selection between two operating speed profiles: a normal operating speed profile and a reduced operating speed profile. The control system compares the measured live load to a pre-selected threshold, such as the car weight plus twice the percentage balancing multiplied by the rated full load of the elevator system. If this threshold is exceeded, then the reduced operating speed profile is selected. In this way, reduced balancing may be used. The selected percentage balancing may be determined empirically or estimated by taking into account the building size, usage and other operational characteristics.

9 Claims, 2 Drawing Sheets

ELEVATOR WITH REDUCED COUNTERWEIGHT

TECHNICAL FIELD

The present invention relates to elevators, and more particularly to elevators that use counterweights.

BACKGROUND OF THE INVENTION

A typical traction elevator includes a car and a counterweight interconnected by a plurality of ropes. The ropes extend over a traction sheave that is driven by a drive machine. The load to be moved by the drive machine is determined by the difference between the load of the car, including passengers and freight, and the load of the counterweight.

It is conventional to provide a counterweight that is equal to the weight of the car plus fifty percent of the full 'live' load, referred to as fifty percent balancing. Live load, as used herein, means the load attributable to the passengers and freight. With fifty percent balancing, the maximum load to be moved by the drive machine is fifty percent of the full live load. This occurs when the car is either fully loaded to its maximum capacity, such that the car is heavier than the counterweight, or is empty, such that the counterweight is heavier than the car.

The drive machine is sized to be able to drive the elevator at its nominal speed for both full car and empty car operations. This results in a machine that has power output sufficient to lift fifty percent of the live load through the hoistway at its nominal speed.

The above art notwithstanding, scientists and engineers under the direction of Applicants' Assignee are working to develop elevator systems that provide both the desired performance and are cost effective.

DISCLOSURE OF THE INVENTION present invention is predicated in part upon the recognition that in many applications, such as residential buildings, an elevator system is rarely carrying a full rated load. Therefore, for most operations the elevator system is over balanced, which results in the necessity of a larger drive machine to operate the elevator at its rated speed during the rare instances when it is fully loaded. Applicants recognized that it would be beneficial to use a smaller drive machine that is capable of operating the elevator system at the rated speed during most operations, but which operates at a second, slower speed if the car is fully loaded.

According to the present invention, an elevator system includes a control system that determines the amount of load of the car, and determines the operating speed profile of the car based upon the amount of load in the car.

In a particular embodiment of the present invention, the control system includes a load weighing device and uses the weight of the live load to determine the selection between two operating speed profiles: a normal operating speed profile and a reduced operating speed profile. The control system compares the determined live load to a predetermined threshold amount. The threshold is based upon the percentage balancing. If the determined live load is greater than the threshold, such as the car weight plus twice the passenger load, then the reduced operating speed profile is selected.

"Operating Speed Profile", as used herein, is defined to include both the operating speed and the acceleration/deceleration profile.

The advantage of the present invention is that it permits the elevator system to use a minimized counterweight to balance the car. This, in turn, permits smaller components, such as the drive machine, to be used with the elevator system because of the smaller loads that have to be driven by the machine at the rated speed. The culmination of these benefits is a more cost effective elevator system than a conventional elevator system.

The foregoing and other objects, features and advantages of the present invention become more apparent in light of the following detailed description of the exemplary embodiments thereof, as illustrated in the accompanying drawings.

BEST MODE FOR CARRYING OUT THE INVENTION

Figure 1:
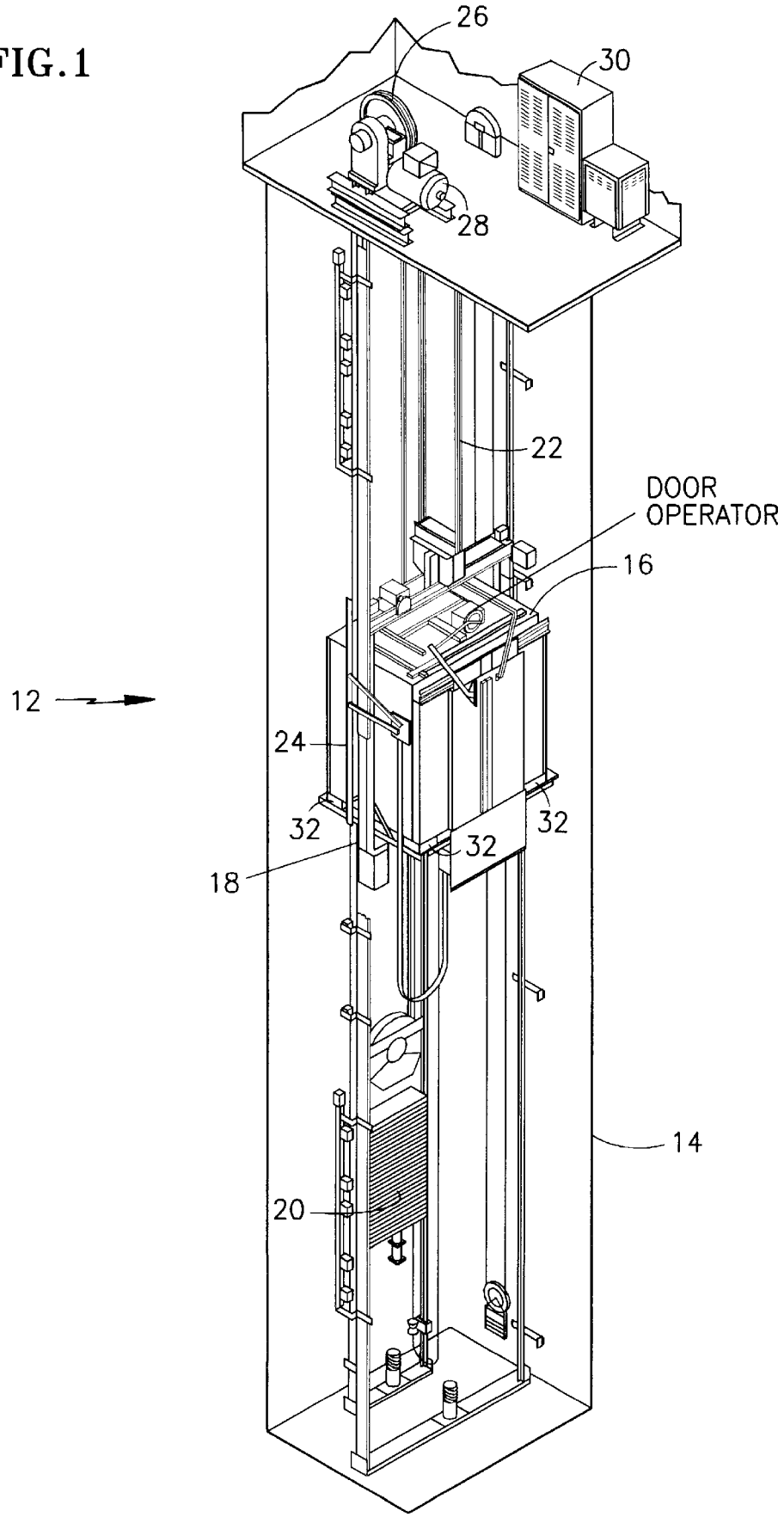
FIG. 1 is a schematic illustration of an elevator system according to the present invention.

Illustrated in FIG. 1 is an elevator system 12 disposed within a hoistway 14. The elevator system 12 includes a cab 16 mounted within a carframe 18, a counterweight 20, and a plurality of ropes 22 extending between the carframe 18 and the counterweight 20. The cab 16 and carframe 18 combined define a car 24. The plurality of ropes 22 extend over a traction sheave 26 that is engaged with a drive machine 28. Operation of the drive machine 28 rotates the traction sheave 26, and thereby the car 24 and counterweight 20 are moved through the hoistway 14. Although FIG. 1 illustrates an elevator system having a conventional 2:1 roping configuration, it will be apparent in view of the description below that the invention is equally applicable to elevator systems having other roping configurations, including 1:1 roping of the car and counterweight.

Operation of the drive machine 28 is controlled by a controller 30. The controller 30 receives inputs from a car operating panel and hall call switches (not shown) and determines the destination of the car 24. In addition, the controller 30 also receives inputs from the car 24, such as from a door operating system, alarms, leveling systems, or other systems not illustrated in FIG. 1, and from a load weighing system 32. The load weighing system 32 defines means to determine the load in the car 24.

The counterweight 20 provides the weight necessary to maintain traction between the ropes 22 and the traction sheave 26 and to counterbalance the weight of the car 24 and its load of passengers and/or freight, hereinafter referred to as 'live' load. In the elevator system 12 illustrated in FIG. 1, the mass of the counterweight 20 is selected based upon the distribution of live load mass $M_{meas}$ during operation of the elevator system 12. This distribution may be determined empirically by taking actual measurements of the installed elevator system, or may be estimated based upon knowledge of the building size, usage and other operational characteristics. For instance, an residential building, such as an apartment building, may have significantly different usage characteristics than a building having predominantly commercial tenants.

Figure 2:
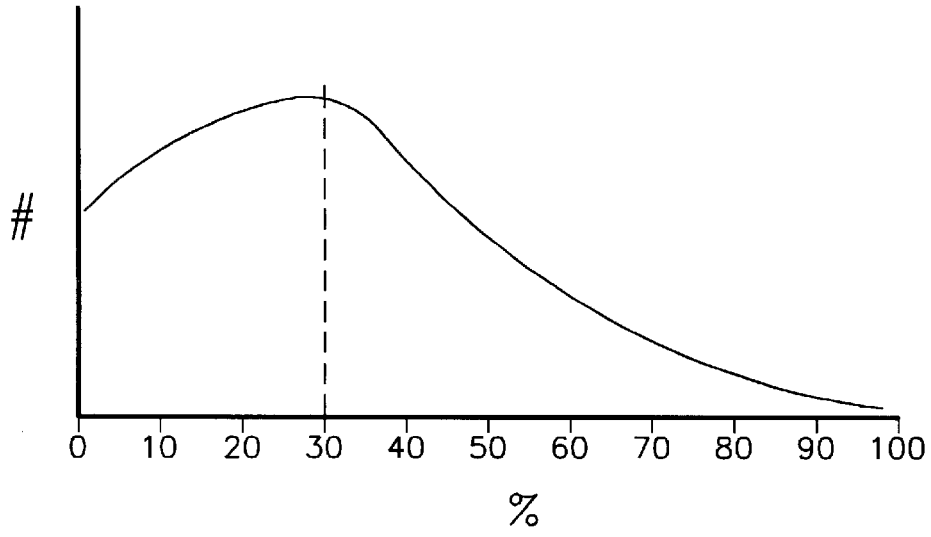
FIG. 2 is a graphical representation of a hypothetical frequency distribution for the operation of the elevator system.

An hypothetical example of a distribution of live load mass is shown graphically in FIG. 2. The ordinate displays the percentage of rated full load for the car 24 and the abscissa displays the number of operational starts or runs of the elevator system 12. As can be seen in this graph, the largest portion of the usage occurs with the car 24 carrying less than fifty percent full load Q, with a median falling at approximately thirty percent.

For a distribution of live load such as shown in FIG. 2 and for an elevator system according to the present invention, the mass $M_{cwt}$ of the counterweight 20 may be set at thirty percent balancing. In this configuration, the weight $M_{cwt}$ of the counterweight 20 would be calculated as follows:

$$M_{cwt,}=M_{car}+(A\times Q)$$

where $M_{car}$ is the mass of the empty car 24 and A is the percentage balancing, or 0.3 in the elevator system 12 described. If $M_{car}$=600 kg and the elevator system 12 is rated for full load Q=600 kg, the weight of the counterweight 20 would be set at $M_{cwt}$=780 kg. This is significantly less than for conventional fifty percent balancing, which would result in a counterweight weighing 900 kg.

The thirty percent balanced elevator system 12 described above is sufficient to operate the elevator system 12 at its rated speed $V_{normal}$ up to approximately twice the percentage balancing, or sixty percent of full load. This will be sufficient for a predominant portion of the distribution shown in FIG. 2. In the less frequent occurrences when the elevator system 12 is carrying a live load greater than sixty percent of full load, the drive machine 28, and thereby the car 24, may be operated at a reduced speed $V_{reduced}$.

Figure 3:
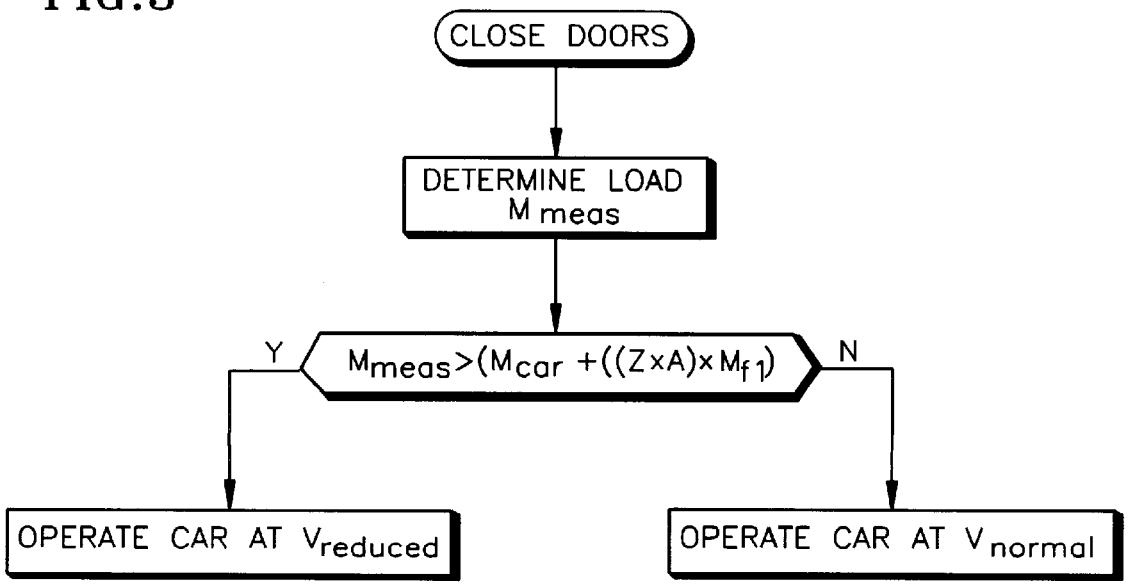
FIG. 3 is a flow chart illustrating the operation of the control system.

The controller 30 includes a control system as illustrated in FIG. 3. The control system 30 determines the operating speed profile of the elevator system 12. Once the car 24 destination is determined and there are no further passengers and/or freight being loaded onto the cab 16, the controller 30 determines that a run is about to begin. The controller 30 uses the inputs received from the load weighing device 32 to determine the amount of live load being carried by the car 24. The controller 30 then compares the measured load $M_{meas}$ to a predetermined threshold amount as follows:

$$M_{meas}>(Z\times A)\times Q$$

where A is the percentage balancing and Z is a predetermined multiplier. In the system described above, A=0.3 and Z=2. If $M_{meas}$ is less than the threshold amount, the controller 30 signals the drive machine 28 to operate the car 24 using a normal acceleration/deceleration profile and a normal speed $V_{normal}$; (if $M_{meas}$ is greater than the threshold amount, the controller 30 signals the drive machine 28 to operate the car 30 using a second acceleration/deceleration profile and a reduced speed $V_{reduced}$.

The system illustrated above is an exemplary embodiment of the present invention. It should be recognized that the distribution of the live load will depend upon the specific application of the elevator system, and therefore the selection of the percentage balancing and the determination of the threshold amount of live load will also depend upon the specific application. In addition, the determination of the actual live load may be performed using a variety of means, including various means to measure the weight of the car, or by measuring the torque on the motor, or by any other method or means.

Although the invention has been shown and described with respect to exemplary embodiments thereof, it should be understood by those skilled in the art that various changes, omissions, and additions may be made thereto, without departing from the spirit and scope of the invention.

What is claimed is:

1. An elevator system having a car and a counterweight, the car having a predetermined mass $M_{car}$, the counterweight having a predetermined mass $M_{cwt}$, and the elevator system having a predetermined maximum load mass Q, and wherein $$M_{cw,}<M_{car}+(A\times Q),$$

wherein 0<A<0.4.

2. The elevator system according to claim 1, further including a car load determining device and a control system, wherein the car load determining device determines the load $M_{meas}$, the control system controlling the speed of the car, the car having a normal operating speed profile and a second operating speed profile, wherein the second operating speed profile has an operating speed $V_{reduced}$ that is less than the operating speed $V_{normal}$ of the normal operating speed profile, and wherein the control system operates the car using the normal operating speed profile if $$M_{meas}\leqq(Z\times A)\times Q,$$

and operates the car using the second operating speed profile if $$M_{meas}>(Z\times A)\times Q,$$

wherein Z≧1.

3. The elevator system according to claim 2, wherein Z=2.

4. The elevator system according to claim 1, wherein the value of A is determined based upon the distribution of load mass during operation of the elevator system.

5. The elevator system according to claim 4, wherein the value of A is determined based upon the median of the distribution of load mass during operation of the elevator system.

6. An elevator system having a car and a counterweight, and the elevator system having a predetermined maximum load mass Q, the elevator system including a car load determining device and a control system, wherein the car load determining device determines the load $M_{meas}$ in the car, and wherein the control system determines the operating speed profile of the car, the car having a normal operating speed profile and a second operating speed profile, wherein the second operating speed profile has an operating speed $V_{reduced}$ that is less than the operating speed $V_{normal}$ of the normal operating speed profile, and wherein the control system selects between the normal and second operating speed profile based upon if the load $M_{meas}$ exceeds a predetermined threshold, wherein the predetermined threshold is a fraction of the predetermined maximum load mass Q.

7. The elevator system according to claim 6, wherein the value of the threshold is determined based upon the distribution of load mass during operation of the elevator system.

8. The elevator system according to claim 7, wherein the value of the threshold is determined based upon the median of the distribution of load mass during operation of the elevator system.

9. A method to operate an elevator system, the elevator system having a car and a counterweight, the car having a predetermined maximum load mass Q, the method including the steps of:

determining the load $M_{meas}$ in the car;

comparing the load $M_{meas}$ to a predetermined threshold, wherein the predetermined threshold is a fraction of the predetermined maximum load mass Q;

operating the car using a normal operating speed profile if the load $M_{meas}$ is less than the predetermined threshold; and operating the car using a reduced operating speed profile if the load $M_{meas}$ is greater than the predetermined threshold, wherein the reduced operating speed profile has an operating speed $V_{reduced}$ that is less than the operating speed $V_{normal}$ of the normal operating speed profile.

* * * * *